US011661249B2

(12) United States Patent
Bores et al.

(10) Patent No.: US 11,661,249 B2
(45) **Date of Patent: *May 30, 2023**

(54) MULTI PIECE FITMENT FOR A FLUID CONTAINER

(71) Applicant: ENTEGRIS, INC, Billerica, MA (US)

(72) Inventors: Gregory W. Bores, Prior Lake, MN (US); Michael J. Schleicher, Victoria, MN (US); John A. Leys, Chaska, MN (US)

(73) Assignee: ENTEGRIS, INC., Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/237,865

(22) Filed: Apr. 22, 2021

(65) Prior Publication Data

US 2021/0331840 A1 Oct. 28, 2021

Related U.S. Application Data

(60) Provisional application No. 63/013,907, filed on Apr. 22, 2020.

(51) Int. Cl.
*B65D 47/06* (2006.01)
*B65D 75/58* (2006.01)

(52) U.S. Cl.
CPC ..... *B65D 47/06* (2013.01); *B65D 75/5877* (2013.01)

(58) Field of Classification Search
CPC .... B65D 47/06; B65D 75/5877; B65D 23/02; B65D 11/04; B65D 81/30; B65D 23/00
USPC ..... 222/570, 93, 94, 105, 196; 383/80
See application file for complete search history.

(56) References Cited

U.S. PATENT DOCUMENTS 5,154,308 A * 10/1992 Larson ..... B65D 39/084 220/288
6,015,068 A * 1/2000 Osgar ..... B67D 7/344 222/400.7
2008/0298727 A1* 12/2008 Edgington ..... B65D 1/0292 383/105
2009/0297769 A1 12/2009 Yan
2010/0108712 A1 5/2010 Manesis
(Continued)

FOREIGN PATENT DOCUMENTS

CN 101734417 B 12/2012
CN 106379635 A 2/2017
(Continued)

*Primary Examiner* — Lien M Ngo

(57) ABSTRACT

This disclosure relates generally to a containment system for containing a fluid. More specifically, the disclosure relates to a fitment for attaching a liner within a container and providing a fluid path from the liner to an outside of the containment system. The liner and at least a part of the fitment provide the wetted surfaces for the containment system, while the fitment has a portion that can be joined to an outer container that, for example, provides rigidity and light protection. The fitment may be a two-piece fitment with a liner fitment to which the liner may be joined, and a retainer that may be joined to a container, where the liner fitment and the retainer are joined to one another, for example by a mechanical connection. The liner and liner fitment may be fluoropolymers or other non-reactive polymers. The container and retainer may be UV-blocking polymers.

12 Claims, 15 Drawing Sheets

(56) References Cited

U.S. PATENT DOCUMENTS

| | | | | |
|---|---|---|---|---|
| 2011/0210148 | A1* | 9/2011 | Nelson | B67D 7/0261 220/303 |
| 2014/0131380 | A1* | 5/2014 | Pethe | B67D 1/0462 222/95 |
| 2014/0374416 | A1 | 12/2014 | Tom | |
| 2015/0108163 | A1 | 4/2015 | Smith | |
| 2016/0200494 | A1 | 7/2016 | Harada | |
| 2016/0229679 | A1 | 8/2016 | Ware | |
| 2016/0318686 | A1 | 11/2016 | Russell | |
| 2017/0210519 | A1* | 7/2017 | Ware | B65D 41/32 |
| 2020/0140175 | A1* | 5/2020 | Richter | B65D 77/065 |
| 2021/0331840 | A1 | 10/2021 | Bores | |

FOREIGN PATENT DOCUMENTS

| | | | |
|---|---|---|---|
| JP | 2015231874 | A | 12/2015 |
| KR | 20110013743 | A | 2/2011 |
| WO | 89075751 | W | 8/1989 |
| WO | 9419242 | W | 9/1994 |

* cited by examiner

MULTI PIECE FITMENT FOR A FLUID CONTAINER

CROSS-REFERENCE TO RELATED APPLICATION

This application claims the benefit of and priority to U.S. Provisional Application No. 63/013,907 filed Apr. 22, 2020, which is incorporated herein by reference in its entirety for all purposes.

FIELD

This disclosure relates generally to a containment system for containing a fluid. More specifically, the disclosure relates to a fitment for attaching a liner within a container and providing a fluid path from the liner to an outside of the containment system.

BACKGROUND

Some manufacturing processes utilize fluid chemicals. The fluid chemicals may include, for example, acids, solvents, bases, photoresists, dopants, inorganic solutions, organic solutions, pharmaceuticals, or the like. In using such chemicals, glass bottles may be utilized to properly contain the chemicals during storage, transport, and ultimately during the manufacturing process itself. Glass bottles are typically used for containers, as they can provide ultraviolet (UV) protection and chemically resistant wetted surfaces for storage and transport of the fluid chemicals.

SUMMARY

This disclosure relates generally to a containment system for containing a fluid. More specifically, the disclosure relates to a fitment for attaching a liner within a container and providing a fluid path from the liner to an outside of the containment system.

Glass bottles are currently used for many manufacturing chemicals. Plastic bottles may offer lower cost over glass bottles. Plastic bottles provide better resistance to shattering and are safer and less difficult to clean up following a drop or other handling incident. Plastic bottles may, through use of materials such as fluoropolymers, also provide reduced contamination of some sensitive chemicals when compared to glass.

Plastics having suitable manufacturing properties for use in bottles, such as stretch-blow-moldable plastics, tend to be reactive with many chemicals used in manufacturing processes. Plastics suitable for containing these chemicals, such as, but not limited to fluoropolymers, are difficult or expensive to manufacture into bottles, and may lack other important properties such as, but not limited to, blocking ultraviolet (UV) radiation.

Embodiments of this disclosure include fitments that allow attachment of a bag within a plastic bottle (e.g., a bag-in-bottle), to allow the wetted surfaces of the container to be made of non-reactive materials, while allowing outer surfaces to use materials having desirable manufacturing properties, and other properties such as UV protection.

In an embodiment, a fitment for a fluid containment system includes a liner fitment having a liner joining surface configured to be joined to a liner and defining a liner fitment aperture, and the liner fitment is joined to a retainer. The retainer defines an aperture suitable for receiving the liner fitment. The liner fitment is held in the aperture by a load-bearing feature formed by an outer surface of the liner fitment and surface of the retainer.

In an embodiment, the liner joining surface is disposed on an annular flange. In an embodiment, the liner joining surface is disposed on one or more curved surfaces extending from a first end point to a second end point.

In an embodiment, the retainer includes one or more vent holes, allowing fluid communication from a first side of the retainer to a second side of the retainer, the second side of the retainer being opposite the first side of the retainer.

In an embodiment, the liner fitment is made of a fluoropolymer. In an embodiment, the retainer is made of a UV-blocking material.

In an embodiment, the retainer includes a polymer that is ultrasonically weldable to a stretch-blow moldable polymer.

In an embodiment, an O-ring is located between the liner fitment and the retainer. In an embodiment, an annular groove is located on an outer surface of the liner fitment, and the O-ring is located within the annular groove.

In an embodiment, a fluid containment system includes a liner, a container, surrounding the liner, and a fitment. The fitment includes a liner fitment having a liner joining surface joined to the liner and defining a liner fitment aperture. The retainer defines an aperture suitable for receiving the liner fitment. The liner fitment is held in the aperture by a load-bearing feature formed by an outer surface of the liner fitment and surface of the retainer.

In an embodiment, the liner is joined to the liner joining surface of the fitment by a weld. In an embodiment, the container is joined to the retainer by a weld.

In an embodiment, the container includes a UV-blocking material. In an embodiment, the container comprises a stretch blow-moldable polymer. In an embodiment, the liner comprises a fluoropolymer.

In an embodiment, a method of manufacturing a containment system includes welding a liner to a fitment at a liner joining surface, placing the liner and the fitment inside a container, pressurizing the liner, and joining the fitment to the container at a container joining surface. In an embodiment, joining the fitment to the container is ultrasonic welding of the container and fitment. In an embodiment, the liner is pressurized when joining the fitment to the container.

BRIEF DESCRIPTION OF THE DRAWINGS

The disclosure may be more completely understood in consideration of the following description of various illustrative embodiments in connection with the accompanying drawings.

Figure 1A:
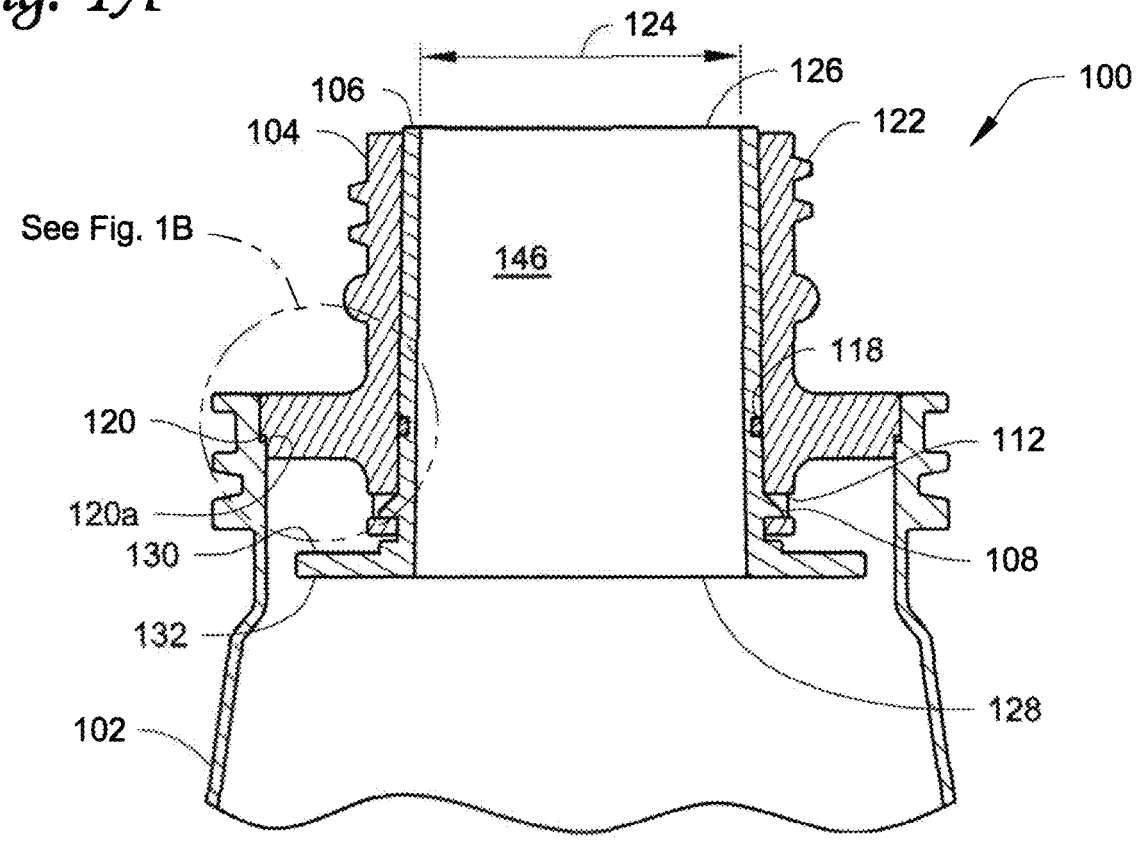
FIG. 1A shows a cross-sectional view of an end of a fluid containment system, according to an embodiment.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DETAILED DESCRIPTION

This disclosure relates generally to a containment system for containing a fluid. More specifically, the disclosure relates to a fitment for attaching a liner within a container and providing a fluid path from the liner to an outside of the containment system.

Some manufacturing processes utilize fluid chemicals. The fluid chemicals may include, for example, acids, solvents, bases, photoresists, dopants, inorganic solutions, organic solutions, pharmaceuticals, or the like. In using such chemicals, a fluid containment system may be utilized to properly contain the chemicals during storage, transport, and ultimately during the manufacturing process itself.

A fluid includes, but is not limited to, a substance that flows or deforms when a shear stress is applied. A fluid can include, for example, a liquid.

FIG. 1A shows a section view of an end of a fluid containment system 100, according to an embodiment. Fluid containment system 100 includes container 102, retainer 104, and liner fitment 106.

Fluid containment system 100 is a system for containing chemicals such as, for example, acids, solvents, bases, photoresists, dopants, inorganic solutions, organic solutions, pharmaceuticals, or the like.

Container 102 is a hollow container capable of holding a fluid located within a liner (not shown), such as the liner described below and shown in FIG. 6. Container 102 may be made of one or more polymers. Container 102 may be made of, for example, a stretch-blow moldable polymer. Examples of materials that may be used in container 102 include polyethylene (PE), poly(ethylene terephthalate) (PET), poly (ethylene terepthate) glycol (PETG), polycyclohexylenedimethylene terephthalic acid (PCTA), polycyclohexylenedimethylene terephthalate glycol (PCTG), polycarbonate (PC), polypropylene (PP), polyamide (PA), polyethersulfone (PES), polyphenylsulfone (PPSU), poly(methyl methacrylate) (PMMA), high impact polystyrene (HIPS), poly(ethylene napthalate) (PEN), poly(ether ketone) (PEEK), cyclic olefin polymers, cyclic olefin copolymers, or the like, and copolymers including those materials.

Container 102 may be a bottle. In an embodiment, container 102 is a bottle having an internal volume of between at or about 1 and at or about 20 liters. Only an end of container 102 is shown in FIG. 1A. The entirety of container 102 is shown in FIG. 1C and described below.

Container 102 may be made of a UV-blocking material, for example by inclusion of additives, pigments, or the like in the material used for the container 102. Container 102 may be made of a material selected for resistance to shattering due to, for example, fluid containment system 100 being dropped during handling. In an embodiment, container 102 is an outer layer of containment system 100, and a liner is located inside of container 102. In an embodiment, container 102 has an opening 144 (FIG. 1C) at an end of the container 102, and a fitment is located at the opening 144. In the embodiment shown in FIG. 1, the fitment located at opening 144 is a fitment including the retainer 104 and the liner fitment 106. In an embodiment, the liner fitment 106 is joined to the bottle at the opening 144. In an embodiment, the liner fitment 106 extends through the opening 144.

In the embodiment shown in FIG. 1A, retainer 104 and liner fitment 106 are joined to one another. As shown in FIG. 1A, retainer 104 is joined to liner fitment 106 by the interface of protrusions 108 from an outer surface 110 (FIG. 1B) of liner fitment 106 with recesses or openings 112 on an inner surface 114 of the retainer 104. In an embodiment, retainer 104 and liner fitment 106 may be joined by friction, such as being sized to be press-fit to one another, or by friction at an O-ring 116 (visible in FIG. 1B) disposed in an O-ring groove, such as O-ring groove 118 disposed on the outer surface 110 of liner fitment 106. In an embodiment, adhesive may be used to join retainer 104 to liner fitment 106. In an embodiment, welding, such as ultrasonic welding, may be used to join retainer 104 to liner fitment 106. O-ring 116 may be made of a material that is softer than the retainer 104 or the liner fitment 106. O-ring 116 may be made of a material selected based on cleanliness and reduction of particle generation from friction between the O-ring 116 and the retainer 104 and/or liner fitment 106.

Retainer 104 may be made of a material capable of being joined to container 102 via, for example, ultrasonic welding, heating, or the like. Capability of being joined may depend on the method of joining, the compatibility of materials, and similarity among the melting points of materials used for container 102 and retainer 104. Retainer 104 may include additives or coatings, such as stabilizers, colorants, or UV-blocking or absorbing materials.

Examples of materials used in retainer 104 may include, for example, PE, PET, PEN, and/or PEEK.

Retainer 104 includes a container joining surface 120, configured to be joined to container 102 at a corresponding joining surface 120*a*. Retainer 104 may include openings 112, having a width, height, and depth capable of receiving protrusions 108 from the liner fitment 106 to secure the liner fitment 106 and the retainer 104 together. Retainer 104 defines an aperture, through which liner fitment 106 may pass. An example of this aperture is shown in FIG. 5 and described below. In an embodiment, an O-ring groove is disposed on retainer 104 on an inner surface facing the retainer aperture. In an embodiment, retainer 104 has threads 122. In an embodiment, threads 122 are located at an end of the retainer 104 that is outside the container 102 when the fluid containment system 100 is assembled. In an embodiment, retainer 104 is configured to be joined to container 102 via a snap-fit.

Liner fitment 106 is made of one or more materials capable of being joined to a liner used with containment system 100. The liner and liner fitment 106 may be joined by, for example, ultrasonic welding, heat sealing, or the like. The joining of liner and liner fitment 106 may form a fluid-impermeable seal between the liner and liner fitment 106 such that a fluid within the liner can only escape via a liner fitment aperture 146 in the liner fitment 106.

A material selected for liner fitment 106 may be selected in part based on the reactivity of the material with a chemical to be stored in the fluid containment system 100. In an embodiment, a liner used with containment system 100 is poly (tetrafluoroethylene) (PTFE), and the liner fitment 106 is a perfluoroalkoxy alkane polymer (PFA).

Liner fitment 106 defines the liner fitment aperture 146 having diameter 124 and passing through the entire liner fitment 106. The liner fitment aperture 146 allows fluid communication from a first end 126 of the liner fitment 106, disposed outside of container 102, and a second end 128 of the liner fitment 106, disposed inside the container 102 when the containment system 100 is assembled. Liner fitment 106 includes a liner joining surface 130. In the embodiment shown in FIG. 1A, the liner joining surface 130 is disposed on a flange 132 extending from the liner fitment 106. In an embodiment, the liner joining surface 130 is joined to a liner via ultrasonic welding. In an embodiment, the liner joining surface 130 is joined to a liner via a heat seal or a heat weld.

The liner (not shown) may be joined to liner fitment 106 at liner joining surface 130 such that fluid within container 102 is held within the liner, the liner and the liner fitment 106 providing wetted surfaces having appropriate and/or desired properties, such as resistance to or compatibility with the fluid to be stored in the fluid containment system 100. Other factors for material selection for the liner may include chemical compatibility with the chemical to be stored, cleanliness of the material (i.e. reduced material loss during storage or handling), ease of cleaning the liners, purity of the material, or other such concerns regarding potential interactions between the liner and a chemical to be stored.

Figure 1B:
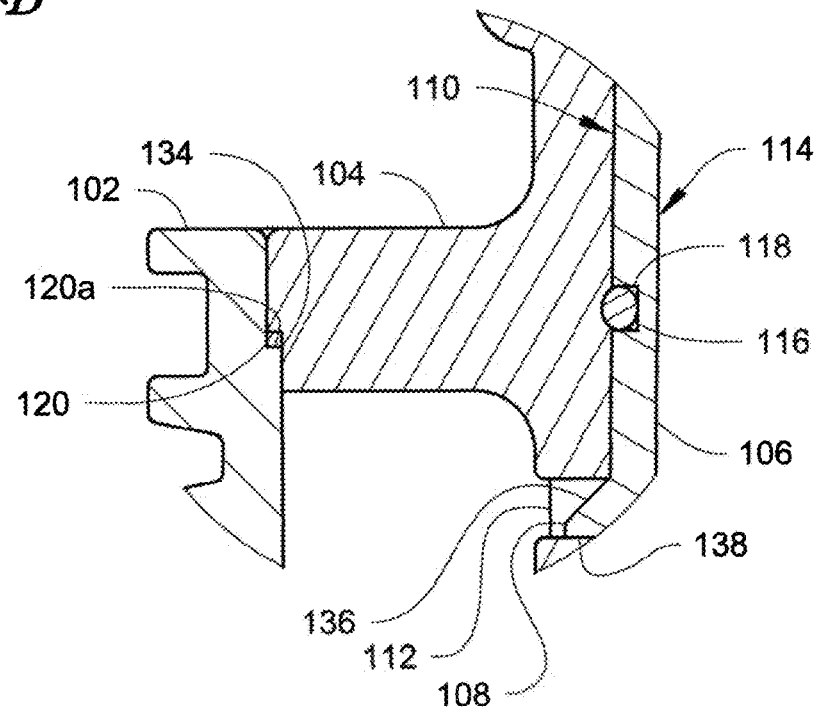
FIG. 1B shows an enlarged view of a portion of the section view of FIG. 1A, according to an embodiment.
Figure 1C:
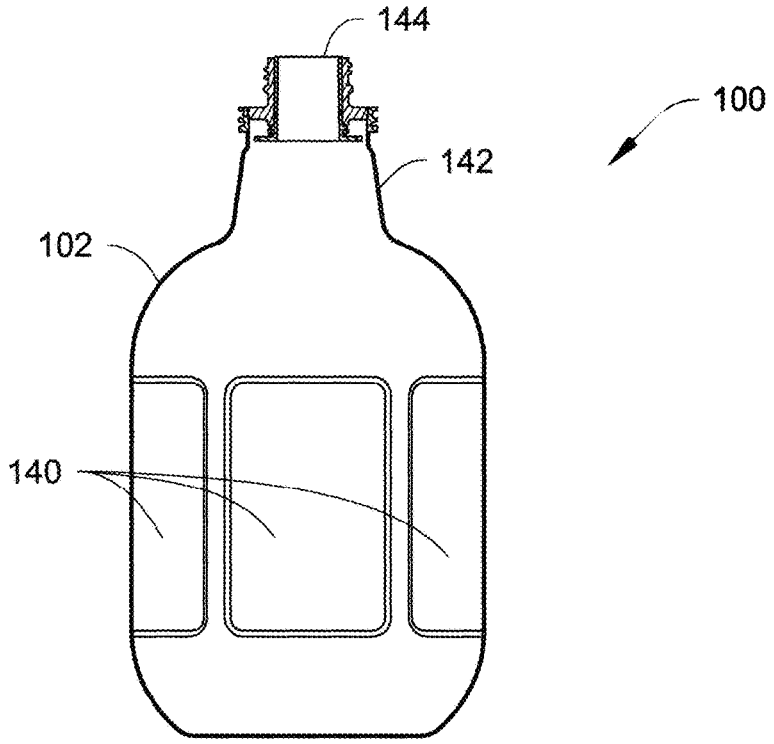
FIG. 1C shows a side view of a containment system, according to an embodiment.

FIG. 1B shows an enlarged portion of the section view of FIG. 1A. FIG. 1B shows the joint between retainer 104 and container 102, according to an embodiment. In the embodiment shown in FIG. 1B, retainer 104 includes container joining surface 120, and the container 102 has a corresponding joining surface 120*a*. In the embodiment shown in FIG. 1B, container 102 has a shear joint 134 which functions as an energy director located at an inner circumferential portion of corresponding joining surface 120*a*. In the embodiment shown in FIG. 1B, shear joint 134 and container joining surface 120 are configured to be ultrasonically welded together. Embodiments may include joining surfaces 120 and corresponding joining surfaces 120*a* configured to be joined via other ultrasonic welding joint structures, such as step joint or tongue and groove ultrasonic welds, or the like. Embodiments may include joining surfaces 120 and corresponding joining surfaces 120*a* configured to be joined through other methods of joining such as heat welds, mechanical connections such as via snaps or threads, adhesives, or the like.

In FIG. 1B, the retainer 104 and liner fitment 106 are joined to one another via the interface between opening 112 of retainer 104 and protrusion 108 from the liner fitment 106. The protrusion 108 from liner fitment 106 has a sloping side 136 over which retainer 104 can be slid, and an engagement face 138. In the embodiment shown in FIG. 1B, the engagement face 138 is parallel to a side of the opening 112 of retainer 104. Engagement face 138 of protrusion 108 engages with a side of an opening 112 in retainer 104 to secure liner fitment 106 to the retainer 104.

Also in FIG. 1B, O-ring 116 can be seen in O-ring groove 118. O-ring 116 may be made of a polymer, such as an elastic polymer, for example rubber or the like. O-ring 116 may provide a seal between retainer 104 and liner fitment 106. In an embodiment, O-ring 116 is used to provide friction between retainer 104 and liner fitment 106 joined to one another.

FIG. 1C shows the entire fluid containment system 100, including the entirety of container 102. As shown in FIG. 1C, container 102 may be, for example, a bottle, and the portion shown in FIG. 1A may be a neck 142 of that bottle. The container 102 may have an opening 144 at the end at which the retainer 104 and liner fitment 106 are connected. The container 102 may include features such as depressed portions 140 shown in FIG. 1C, raised portions, textured portions, handles, or other such features. Surface features such as depressed portions 140 may be added, for example, to improve aesthetics, handling, bottle strength, or suitable combinations thereof.

Figure 2A:
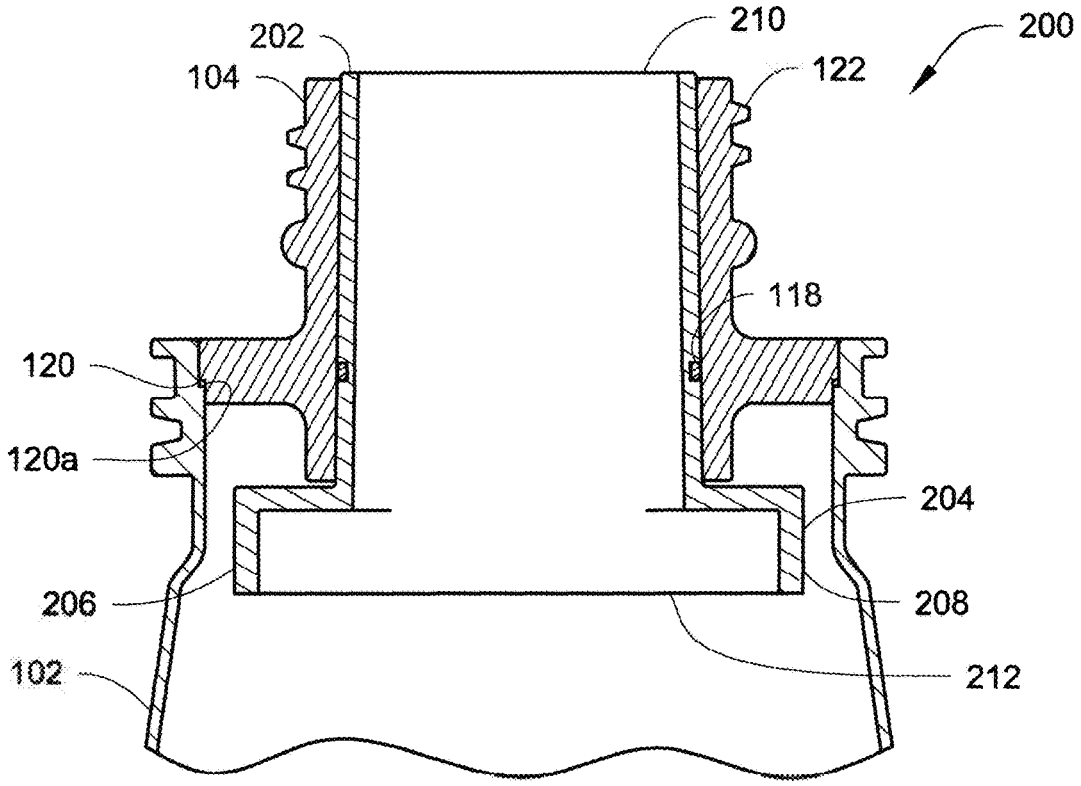
FIG. 2A shows a section view of a fluid containment system, according to an embodiment.

FIG. 2A shows a section view of an end of a fluid containment system 200, according to an embodiment. In the embodiment shown in FIG. 2A, the fluid containment system 200 includes container 102 and retainer 104, along with all of the features of those elements as shown in FIGS. 1A-1C and described above, as well as liner fitment 202.

Liner fitment 202 includes the O-ring groove 118, as in liner fitment 106 described above. Liner fitment 202 defines an aperture 210 extending from a first end of liner fitment 202 to a second end of liner fitment 202. Liner fitment 202 may be made of the same materials as liner fitment 106 described above. In liner fitment 202, liner joining surface 204 is located on first end point 206, second end point 208, and one or more curved surfaces (not shown) extending from the first end point 206 to the second end point 208. Curved surfaces such as those on which liner joining surface 204 may be disposed are visible in FIGS. 4A and 4C and are described below.

Figure 2B:
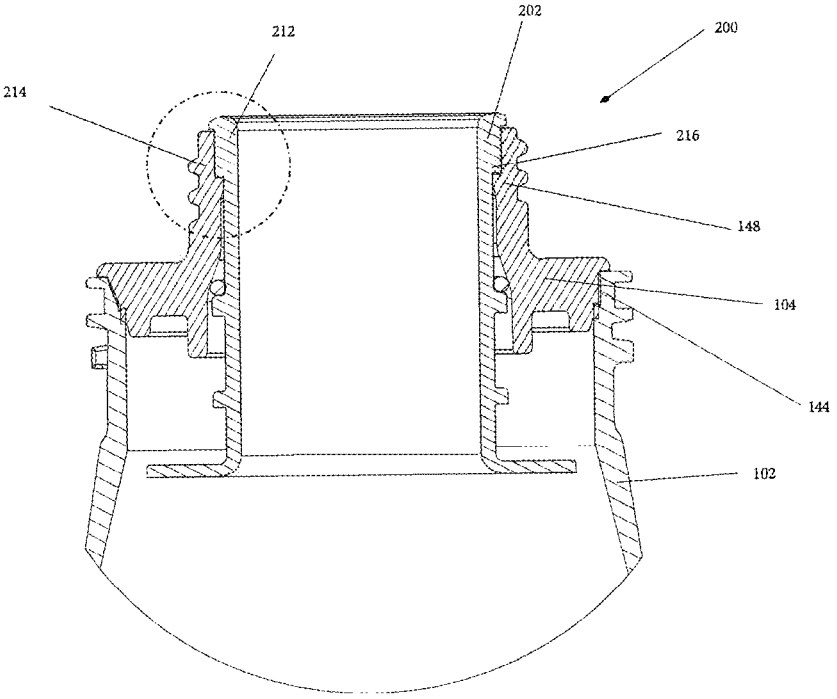
FIG. 2B shows a section view of a fluid containment system, according to an embodiment.

In another embodiment, the retainer may include one or more load-bearing features to engage the liner fitment and create a seal between the liner fitment and the retainer. FIG. 2B depicts one particular embodiment of the fluid containment system 200 with a container 102 having a retainer 104 secured in an opening 144 of the container 102. A liner fitment 202 is secured in the retainer 104 by pressing the top edge 212 of the liner fitment 202 through the aperture 214 of the retainer 104 until a load bearing feature 216 of the liner fitment 202 passes a load-bearing feature 148 on the retainer 104. The mating of load-bearing features 148, 216 seats the liner fitment 202 securely within the retainer 104. The retainer 104, the liner fitment 202 or both are molded polymers that may be resilient enough to allow movement of the liner fitment 202 through the retainer 104 into the seating alignment. Once the liner fitment 202 is seated, it may not be easily retracted from the retainer 104.

Figure 2C:
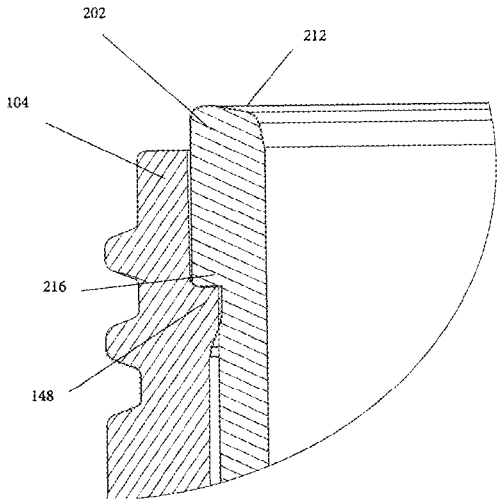
FIG. 2C shows a section view of a load bearing feature of fluid containment system, according to an embodiment.
Figure 2D:
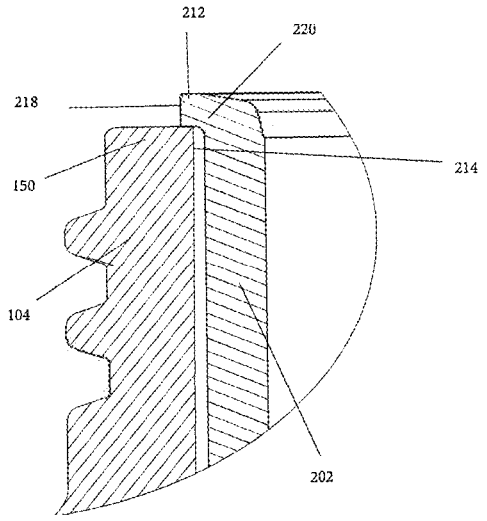
FIG. 2D shows a section view of a load bearing feature of a fluid containment system, according to an embodiment.

One of ordinary skill in the art with knowledge of this disclosure will recognize that the load bearing features of the retainer and the liner fitment may be placed at various locations to secure the liner fitment in the retainer. FIGS. 2C and 2D are non-limiting examples of two potential load-bearing features. In FIG. 2C, a load-bearing feature 148 of the retainer 104 and a load-bearing feature 216 of the liner fitment 202 are positioned at location below the top edge 212 of liner fitment 202. FIG. 2D depicts an alternative location for a load-bearing feature. In FIG. 2D, the load-bearing feature includes an annular surface 218 on an end of the liner fitment 202. The annular surface 218 extends beyond the aperture 214 of the retainer 104 to form a seat at an upper edge 150 of the retainer. The load-bearing features described may be used singularly or in combination, such as illustrated in FIG. 2B, to matingly engage the retainer 104 and liner fitment. Additionally, other sealing options, such as an O-ring, may be employed to enhance the seal between the retainer and the fitment liner.

Liner fitment 202 may include protrusions such as protrusions 108 shown on liner fitment 106 in FIGS. 1A and 1B; however, these are not visible in the section view of FIG. 2. Such protrusions may engage retainer 104 to fix liner fitment 202 to retainer 104. Such protrusions are also visible in the example liner fitment 400 shown in FIGS. 4A and 4C.

Figure 3A:
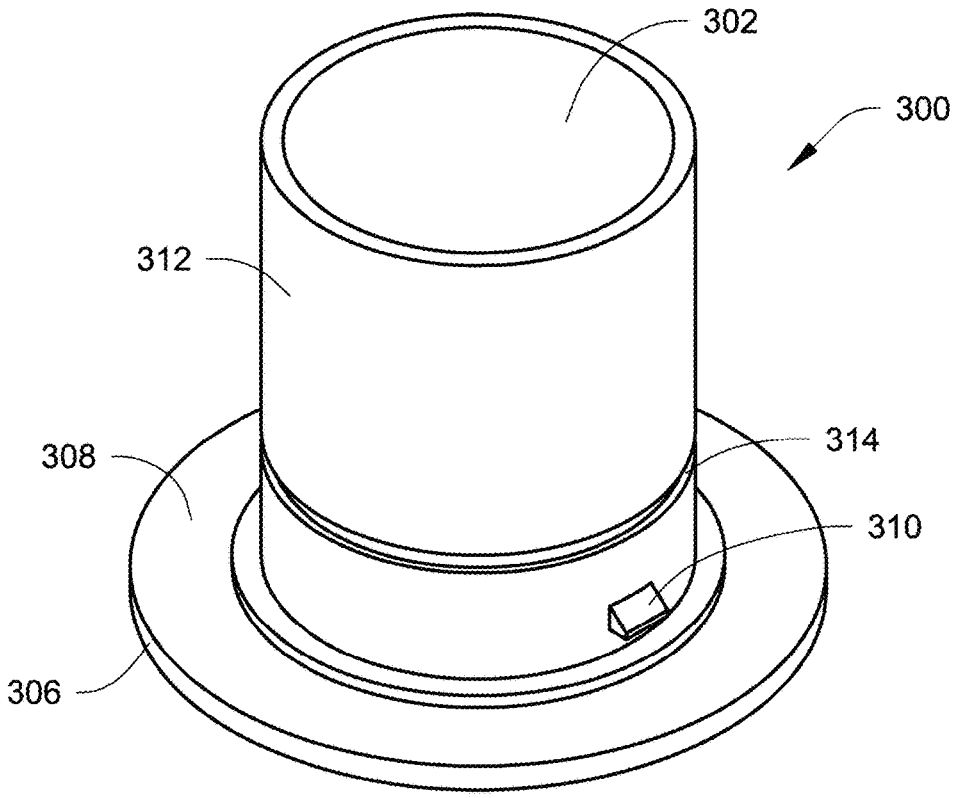
FIG. 3A shows a perspective view of a liner fitment, according to an embodiment.

FIG. 3A shows a perspective view of a liner fitment 300, according to an embodiment. Liner fitment 300 defines liner fitment aperture 302, which extends through a length direction 304 (visible in FIG. 3B) of the liner fitment 300. Liner fitment 300 includes flange 306. Liner joining surface 308 is disposed on a surface of flange 306. In the embodiment shown in FIG. 3A, projections 310 are disposed on outer surface 312 of the liner fitment 300. In the embodiment shown in FIG. 3A, an O-ring groove 314 is also disposed on outer surface 312 of the liner fitment 300.

Liner fitment aperture 302 is an opening extending in the length direction 304 of liner fitment 300. When a liner (not shown) is attached to the liner fitment aperture 302 at the liner joining surface 308, the liner fitment aperture 302 allows fluid communication into and out of the liner, and provides the wetted surface between the inside of the liner and outside of a fluid containment system including the liner fitment 300. In an embodiment, the wetted surface provided by liner fitment 300 is one or more polymers that are non-reactive with a chemical to be stored in a fluid containment system including the liner fitment 300, such as fluoropolymers, including homopolymers and copolymers of fluoropolymers. In an embodiment, the liner fitment 300 is made entirely of one or more polymers that are non-reactive with a chemical to be stored in a fluid containment system including the liner fitment 300, such as fluoropolymers, including homopolymers and copolymers of fluoropolymers.

Flange 306 extends from liner fitment 300. In the embodiment shown in FIG. 3A, flange 306 is an annular projection from an end of the liner fitment 300. In an embodiment, flange 306 is continuous. In embodiments where the flange is discontinuous, part or all of the width of the flange may include the discontinuities. In an embodiment where the flange is discontinuous, the flange includes one or more openings through the flange. In the embodiment shown in FIG. 3A, the liner joining surface 308 is disposed on an upper surface of the flange 306. The liner joining surface 308 is a surface configured to be joined to a liner. The connection between the liner and liner joining surface 308 may be fluid-impermeable and may be via, for example, a weld such as an ultrasonic weld or a heat weld. In an embodiment, the material at liner joining surface 308 is the same material as used in the liner to be used with liner fitment 300.

Figure 3B:
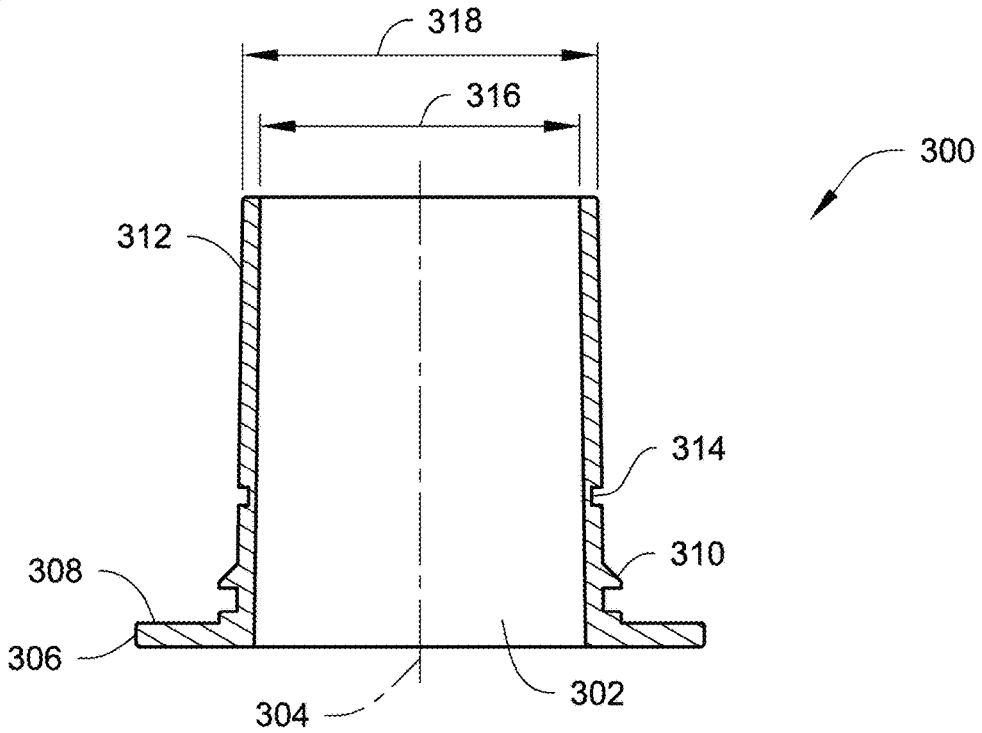
FIG. 3B shows a section view of a liner fitment according to the embodiment shown in FIG. 3A.

FIG. 3B shows a section view of liner fitment 300 according to the embodiment shown in FIG. 3A. In the section view of FIG. 3B, the length direction 304 of the liner fitment, is visible. Liner fitment aperture 302 extends the entire length of liner fitment 300 in this length direction 304. The liner fitment 300 has a first end inner diameter 316 and a first end outer diameter 318. In an embodiment, the first end inner diameter 316 is selected to allow insertion of a tube into a liner attached to liner fitment 300 to allow fluid to be extracted from the liner via the tube. In an embodiment, an inner diameter of a retainer to be used with the liner fitment 300 is selected to be greater than the first end outer diameter 318 of liner fitment 300.

Figure 4A:
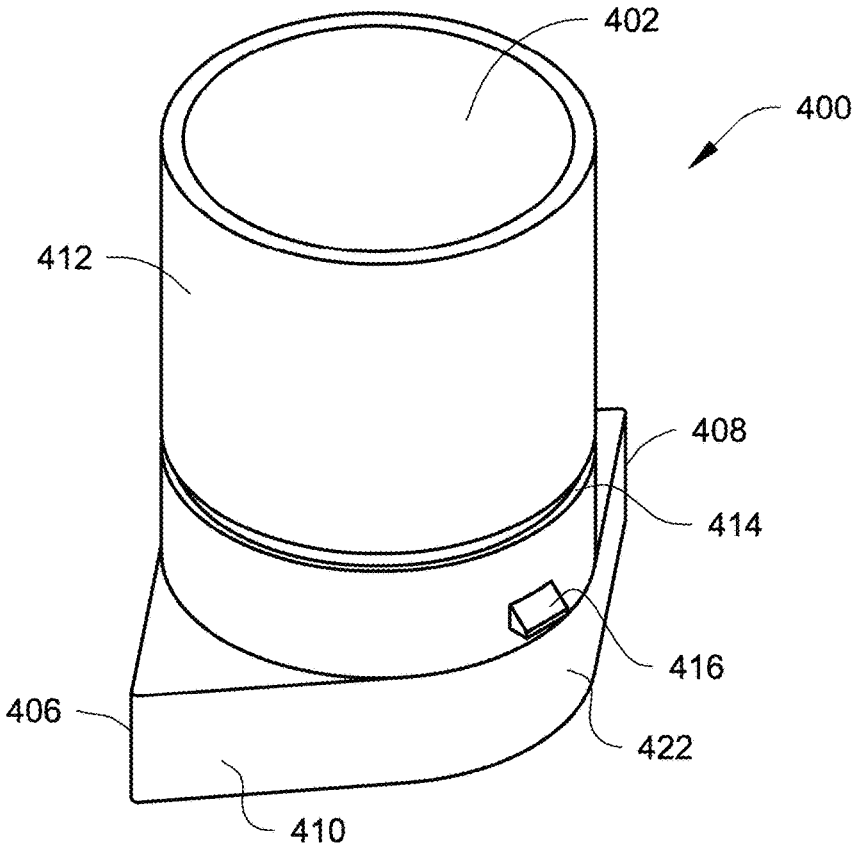
FIG. 4A shows a perspective view of a liner fitment, according to an embodiment.

FIG. 4A shows a perspective view of a liner fitment 400, according to an embodiment. Liner fitment 400 defines a liner fitment aperture 402. Liner fitment aperture 402 is an opening in liner fitment 400 extending in a length direction 404 (shown in FIG. 4B) of the liner fitment 400.

Liner fitment 400 includes liner joining surface 410. Liner joining surface 410 is configured to allow the liner fitment 400 to be joined to a liner. The liner may be joined to the liner joining surface 410 via a fluid-impermeable seal by, for example, an ultrasonic weld or heat sealing. The liner joining surface 410 may be configured to be joined to the liner by, for example, ultrasonic welding. In an embodiment, the material at the liner joining surfaces 410 or for the entire liner fitment 400 is selected based on compatibility with chemicals to be stored within the liner. For example, in an embodiment, liner fitment 400 is made of PFA when the liner fitment 400 is to be used with a liner made of PTFE.

Liner fitment 400 has outer surface 412. On outer surface 412, an O-ring groove 414 may be disposed. O-ring groove 414 is an annular groove in outer surface 412 having a depth and width to receive an O-ring and, in some embodiments, to allow a portion of the O-ring to protrude past outer surface 412 such that it may contact a retainer used with liner fitment 400, for example to form a seal between the liner fitment 400 and the retainer used with the liner fitment 400. The seal formed via the O-ring may be a fluid-impermeable seal. The O-ring may be made of a polymer, for example an elastic polymer such as rubber. The O-ring may be the same as or similar to the O-ring 116 shown in FIG. 1B and described above.

Protrusions 416 may extend from outer surface 412 of liner fitment 400. The protrusions 416 may be configured to engage with recesses on a retainer to be used with the liner fitment 400.

Figure 4B:
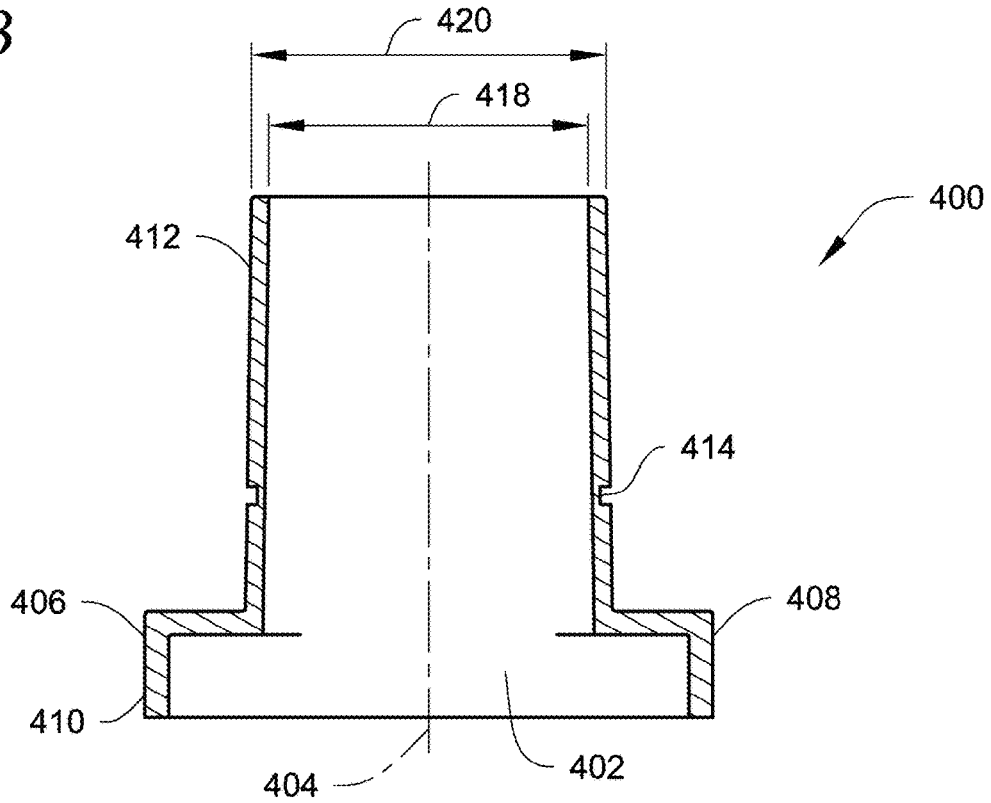
FIG. 4B shows a section view of a liner fitment according to the embodiment shown in FIG. 4A.

FIG. 4B shows a section view of liner fitment 400 according to the embodiment shown in FIG. 4A. In the sectional view, the length direction 404 of the liner fitment 400, along which liner fitment aperture 402 extends, is visible. In the sectional view, an inner diameter 418 of the liner fitment 400 is visible, and defines the diameter of the liner fitment aperture 402 at an end of the liner fitment 400. The liner fitment 400 also has an outer diameter 420 at that end. A thickness of the liner fitment 400 at the end is half of a difference between the inner diameter 418 and the outer diameter 420 of the liner fitment. The thickness of the liner fitment 400 may vary along the length direction 404 of the liner fitment 400. A retainer to be used with liner fitment 400 will have an aperture that has a diameter at least about that of outer diameter 420 of the liner fitment, such that the liner fitment 400 can be inserted into the aperture of the retainer. In an embodiment, the retainer will have an aperture having a diameter selected to be approximately equal or slightly smaller than outer diameter 420 of the liner fitment, such that the retainer may be press-fit with the liner fitment 400 when assembled.

Figure 4C:
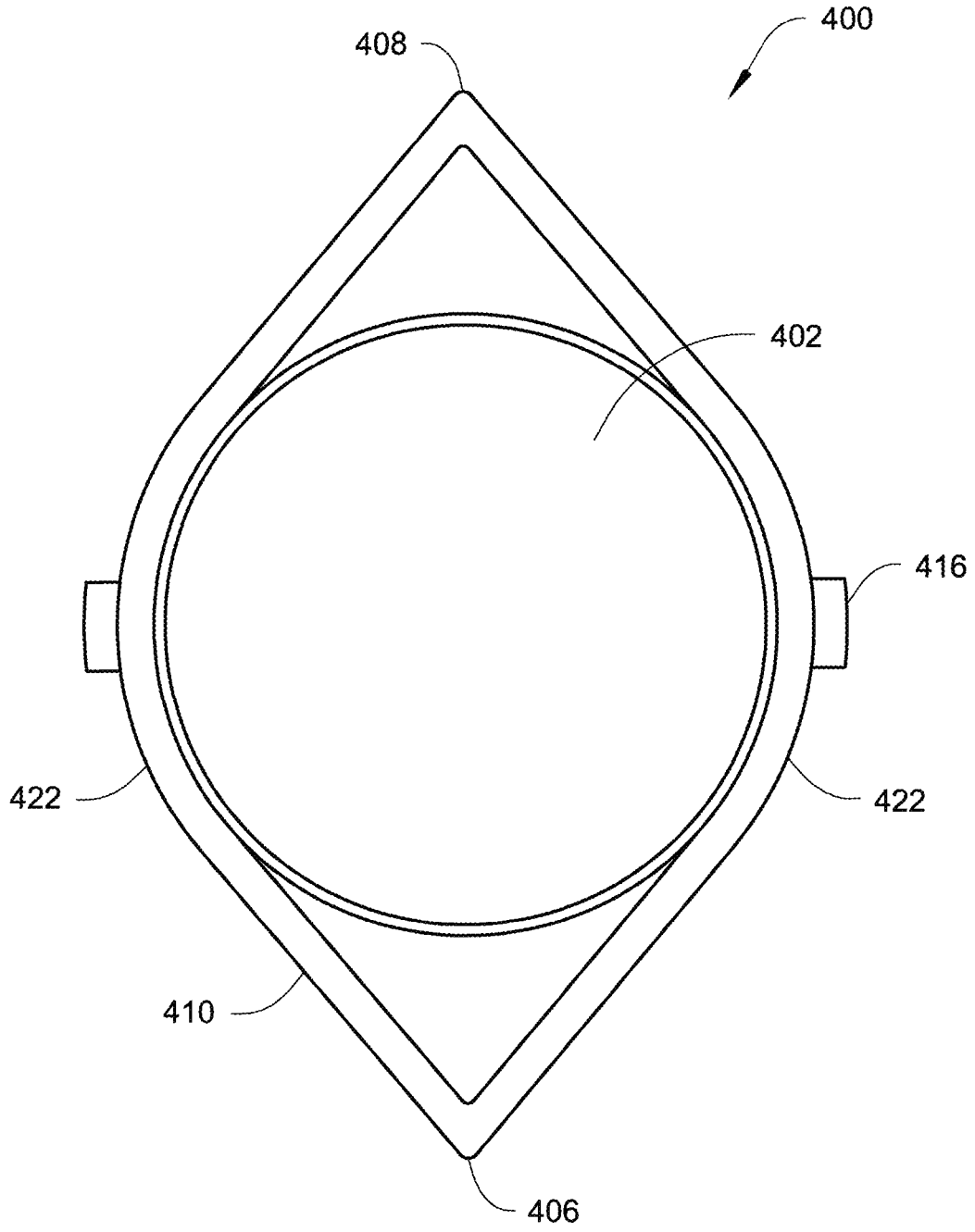
FIG. 4C shows a bottom view of a liner fitment according to the embodiment shown in FIG. 4A.

FIG. 4C shows a bottom view of liner fitment 400 according to the embodiment shown in FIG. 4A. In FIG. 4C, protrusions 416 are visible. Both surfaces 422 extending from first end point 406 to second endpoint 408 are shown in FIG. 4C. Liner joining surface 410 is disposed on each of surfaces 422 and at first and second end points 406, 408. Liner fitment aperture 402 extends through the entirety of the liner fitment 400. As shown in FIG. 4C, in a bottom or top view of the liner fitment 400, the surfaces 422 and end points 406, 408, form a regular diagonal, where an angle formed between the surfaces 422 at end points 406 and 408 equal one another, and the surfaces 422 have equal lengths and curvatures.

Figure 5A:
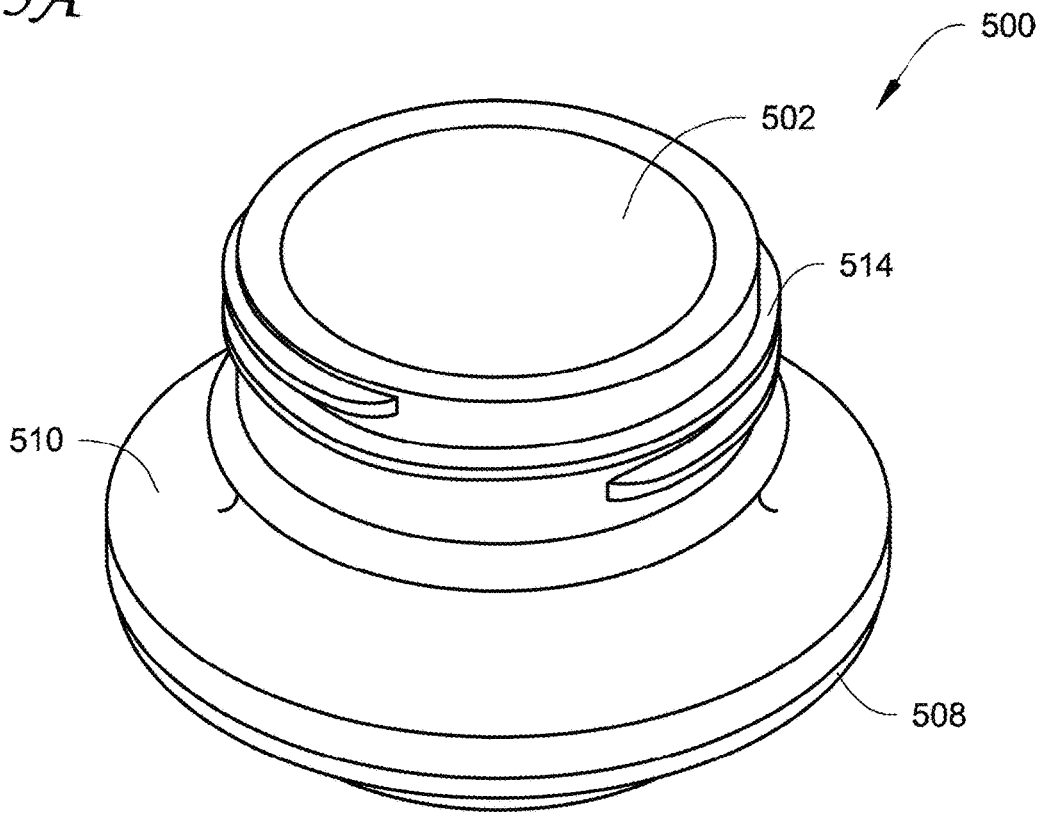
FIG. 5A shows a perspective view of a retainer, according to an embodiment.

FIG. 5A shows a perspective view of a retainer 500, according to an embodiment. Retainer 500 defines a retainer aperture 502 along a length direction 504 (FIG. 5B) of the retainer 500. In the embodiment shown in FIG. 5A, retainer 500 includes multiple openings (shown in FIG. 5B as 506) configured to receive projections from a liner fitment such as projections 310 of liner fitment 300 shown in FIG. 3A or projections 416 of liner fitment 400 shown in FIG. 4A. Retainer 500 may include a container joining surface (shown in FIG. 5B as 508). In the embodiment shown in FIGS. 5A and 5B, the container joining surface 508 is located on a retainer flange 510.

Retainer aperture 502 is an opening defined by retainer 500. Retainer aperture 502 has an inner diameter 512 that is about the same size or larger than an outer diameter of a liner fitment such as outer diameter 318 of liner fitment 300 or outer diameter 420 of liner fitment 400 that is used with retainer 500. This allows the liner fitment 300 or 400 to be inserted into retainer aperture 502. In an embodiment, liner fitment 300 or 400 may project through the retainer 500 such that the liner fitment 300 or 400 provides the entire wetted surface from the liner to outside the fluid containment system, for example, fluid containment system 100 or fluid containment system 200 when the fluid containment systems 100, 200 are assembled.

Retainer 500 includes threads 514 on an outer surface of the retainer 500. Threads 514 may be used, for example, to attach a cap enclosing a containment system including retainer 500. In an embodiment, retainer 500 may not include threads 514 at an end. In an embodiment, another connector such as a lip for engaging a cap may be present on retainer 500. In an embodiment, retainer 500 may include features configured to engage with a cap to form a snap fit between the retainer and the cap.

Retainer flange 510 extends outwards from retainer 500. Retainer flange 510 may be an annular flange, surrounding the entirety of retainer 500. Retainer flange 510 may include one or more vent holes. The vent holes may allow fluid communication between an outside of a fluid containment system including the retainer 500 and a space between a liner joined to a liner fitment and a container joined to the container joining surface 508. In an embodiment, the vent holes are used to pressurize the space between the container and the liner when dispensing a chemical stored in the liner of the fluid containment system. In the embodiment shown in FIG. 5, retainer flange 510 is continuous. In an embodiment, the retainer flange 510 includes one or more discontinuities in some or all of the retainer flange 510 as it extends away from retainer 500. In an embodiment the discontinuities form vent holes at the edges of retainer flange 510 and gaps in the container joining surface 508 corresponding to the discontinuities in the flange 510. In an embodiment, the vent holes allow air to escape or enter the container in response to changes in volume for the liner.

Figure 5B:
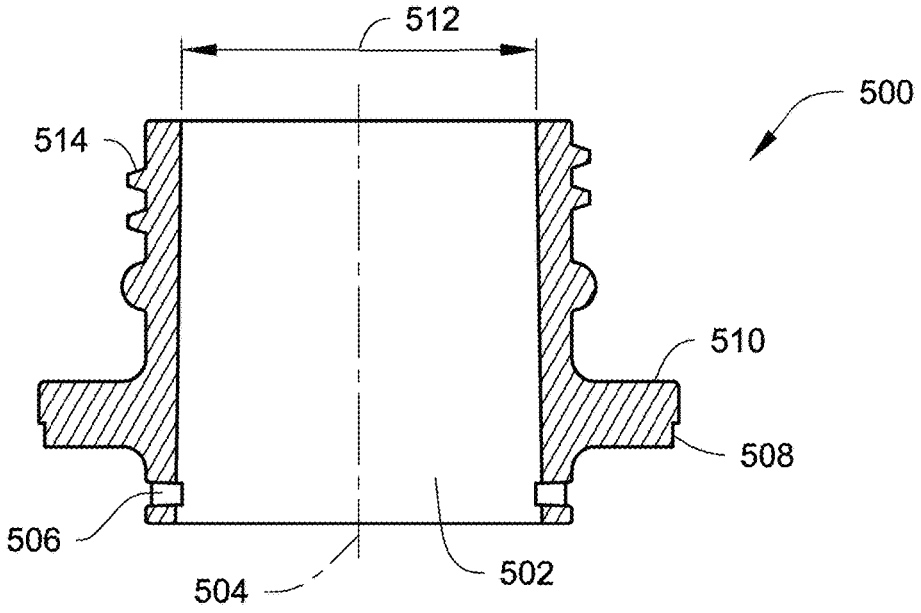
FIG. 5B shows a section view of a retainer according to the embodiment shown in FIG. 5A.

FIG. 5B shows a section view of retainer 500 according to the embodiment shown in FIG. 5A. In the view of FIG. 5B, openings 506 described above are visible, as is container joining surface 508. FIG. 5B shows the length direction 504 of retainer 500, along which retainer aperture 502 extends.

Container joining surface 508 may be located on flange 510 of retainer 500. Container joining surface 508 may be a surface configured to be joined to a container, such as container 102 shown in FIGS. 1A-1C and described above. In an embodiment, container joining surface 508 is positioned to be welded to the container. In an embodiment, container joining surface 508 is a flat surface that is configured to contact an energy director on a corresponding joining surface of a container upon ultrasonic welding.

In an embodiment, container joining surface 508 is a position for adhesive to be used to join the retainer 500 to a container. In an embodiment, container joining surface 508 may be configured to be mechanically joined to the container, for example via threads, snaps, an interference fit, or the like. Container joining surface 508 may be continuous, for example extending around an entire circumference of flange 510 where flange 510 is an annular flange. In an embodiment, container joining surface 508 is discontinuous to form vent holes allowing fluid communication between a space outside the containment system and a space between a container and a liner of the containment system.

Openings 506 are openings in retainer 500 having a height 516, width (not visible in the section view of FIG. 5B), orientation, and depth 518 are configured to receive protrusions on a liner fitment used with the retainer, such as protrusions 310 of liner fitment 300 or protrusions 416 of liner fitment 400 described above. The openings 506 of the retainer 500 and the protrusions 310 of liner fitment 300 or protrusions 416 of liner fitment 400 described above combine to provide a snap fit joining liner fitment 300 or liner fitment 400 to retainer 500.

Figure 6A:
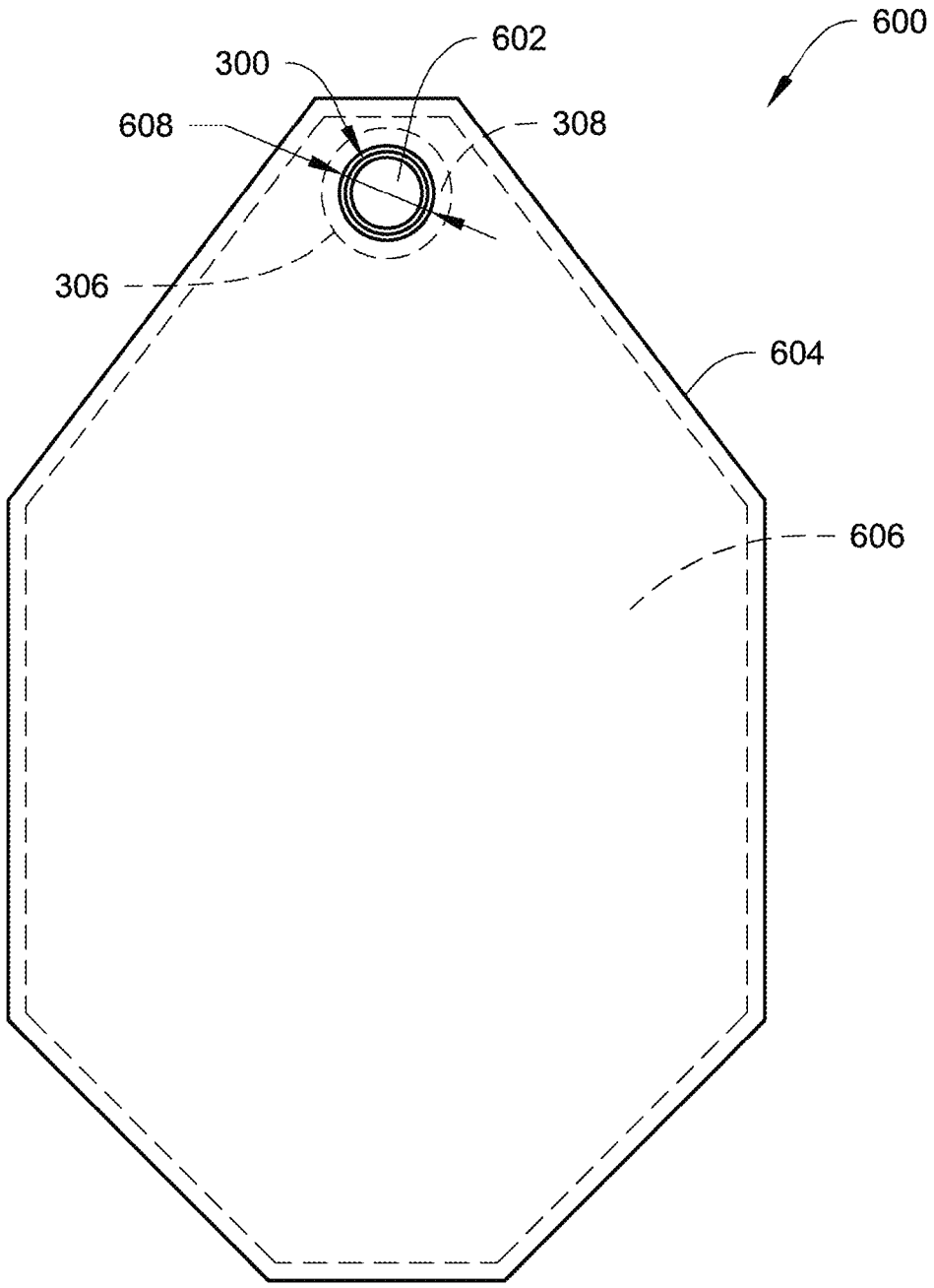
FIG. 6A shows a liner and liner fitment, according to an embodiment.

FIG. 6A shows a liner 600, according to an embodiment. The liner 600 in the embodiment shown in FIG. 6 can be used with liner fitment 300, as described above and shown in FIG. 3.

Liner 600 contains a fluid when the fluid is stored in a fluid containment system including the liner 600, such as fluid containment system 100 or fluid containment system 200. Liner 600 is formed of a top sheet and a bottom sheet. The top sheet, bottom sheet, and liner fitment 300 are joined using a joining method that results in a fluid-impermeable seal, such as a weld, for example an ultrasonic weld or heat seal.

The liner fitment 300 can be placed such that the flange 306, on which liner joining surface 308 is disposed, is located between the bottom sheet and the top sheet, with the liner fitment 300 protruding through an opening 602 in the top sheet. Opening 602 has a diameter 608 that is larger than a diameter of the liner fitment 300 at an end of the liner fitment aperture 302, but smaller than the smallest diameter of flange 306 of the liner fitment 300. In an embodiment, liner fitment 300 protrudes out of the liner 600. In an embodiment, a seal can be formed preventing fluids from escaping liner 600 except through liner fitment aperture 302 of liner fitment 300.

Liner 600 may be closed by joining the edges 604 of the top sheet and the bottom sheet to form a seal around the edges 604, and allowing fluid to be stored in a space 606 between the top sheet and bottom sheet and between the sealed edges 604.

In an embodiment, liner 600 is joined to a liner fitment such as liner fitment 400 having joining surfaces located on curved surfaces between two end points instead of on a flange. When liner 600 is used with a liner fitment such as liner fitment 400, the bottom sheet, top sheet, and the liner fitment 400 are arranged such that an edge of each of the bottom sheet and the top sheet each contact a curved surface 422 on which a liner joining surface 410 of the liner fitment 400 is disposed. Edges 604 of the top sheet and bottom sheet are joined to one another and to the liner joining surfaces 410. When liner 600 is used with a liner fitment such as liner fitment 400, opening 602 may be omitted from the sheets used to form the liner 600. When liner 600 is used with a liner fitment such as liner fitment 400, the top and bottom sheets and the liner fitment 400 may be joined to one another during one joining process such as ultrasonic welding or heat welding.

Liner 600 may be made of a polymer. Liner 600 may be made of a polymer that is impermeable to the fluid to be contained by the containment system including liner 600. Liner 600 may be made of a flexible polymer such that the liner may be expanded when pressurized. In an embodiment, liner 600 is made of a polymer selected based on chemical resistance or compatibility with the fluid to be contained by the containment system including liner 600. In an embodiment, liner 600 is made of a fluoropolymer, which may be a homopolymer or a copolymer of a fluoropolymer. In an embodiment, liner 600 is PTFE. In an embodiment, a liner fitment such as liner fitment 300 or liner fitment 400 is made of a material selected to be ultrasonically weldable to the liner 600, such as PFA when the liner 600 is PTFE. In an embodiment, the liner may be, for example, polyolefins, or any other polymer suitable for containing chemicals to be used with a containment system including the liner, based on, for example, chemical compatibility, purity, and cleanliness of the liner material.

Figure 6B:
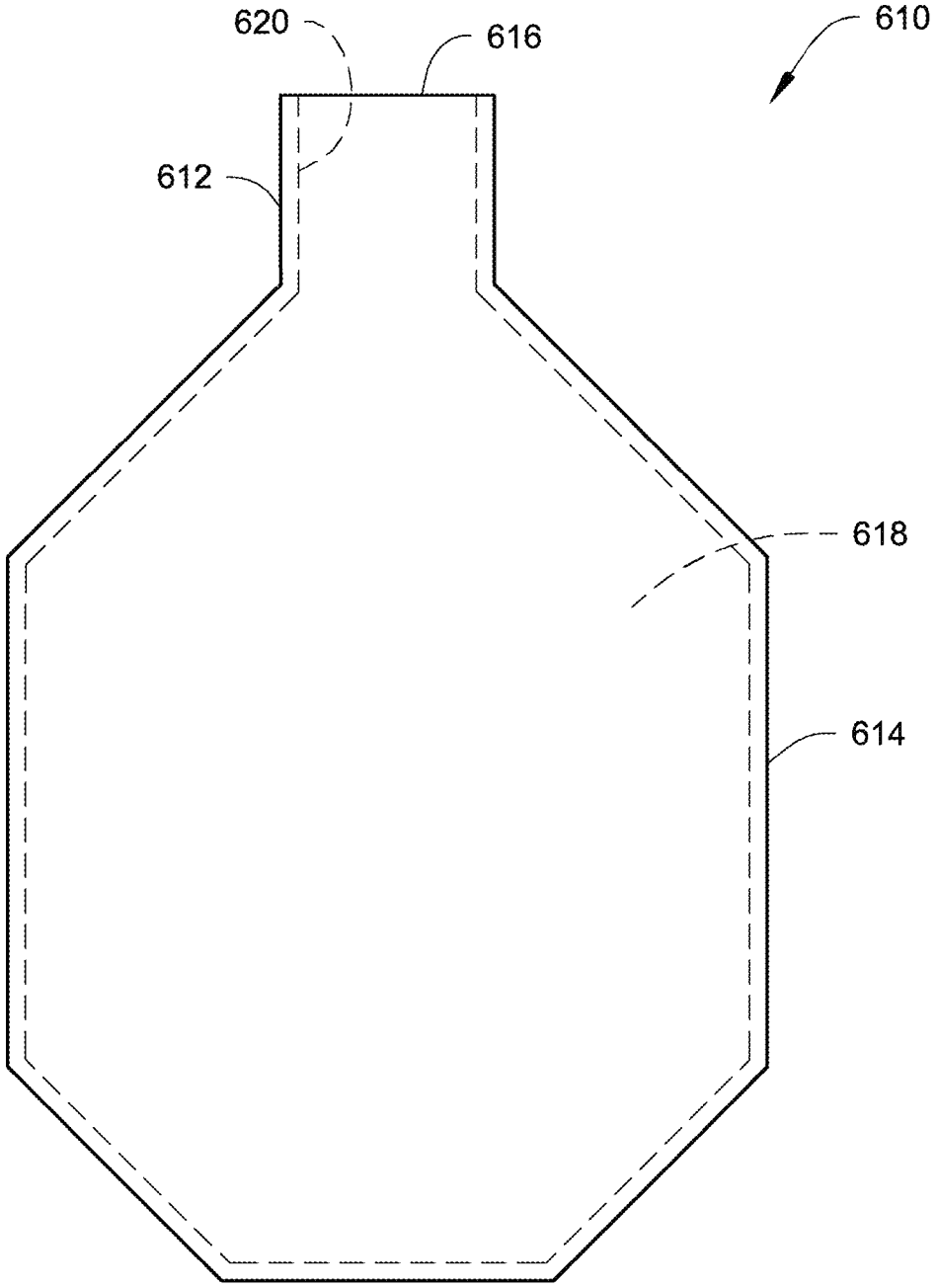
FIG. 6B shows a liner according, to an embodiment.

FIG. 6B shows a liner 610 according to an embodiment. The liner 610 is configured to be used with a fitment as shown in FIGS. 4A-4C. Liner 610 has neck 612. When the edges 614 of the layers of liner 610 are joined, to form the liner, the edge at an end 616 of the neck 612 is not joined and allows fluid flow between the outside of the liner and space 618 between the joined layers of the liner. When liner 610 is used with liner fitment 400, the inner surfaces 620 of the neck 612 are joined to the liner joining surface 410 by a heat seal or an ultrasonic weld.

Figure 7:
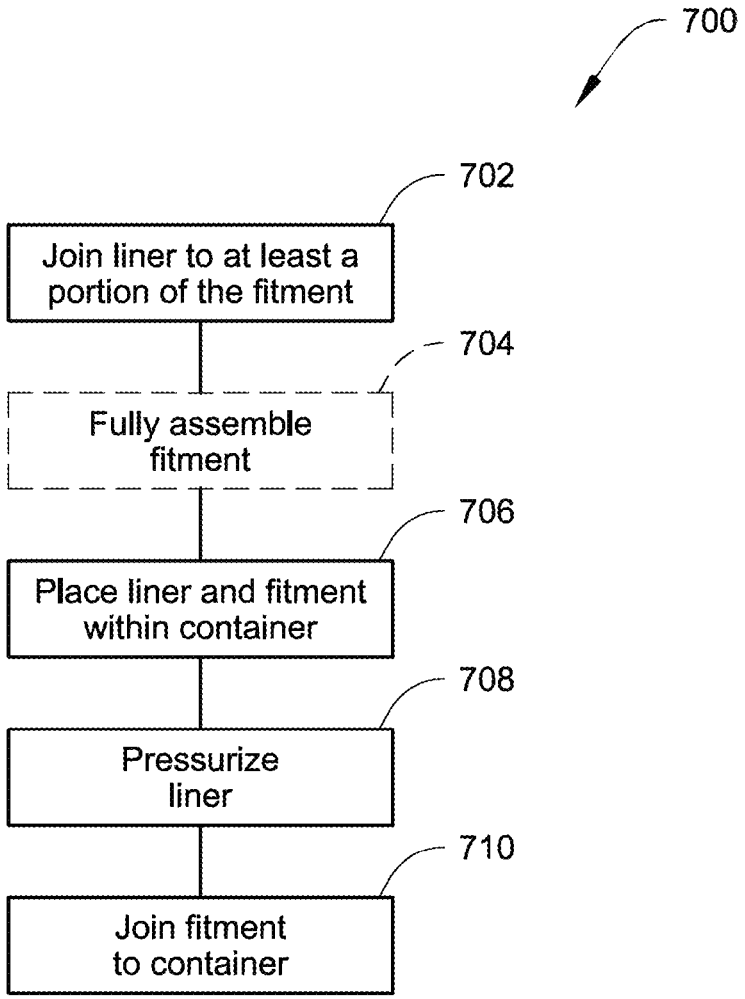
FIG. 7 is a flowchart of a method of manufacturing a container, according to an embodiment.

FIG. 7 is a flowchart of a method of manufacturing a containment system 700, according to an embodiment. The liner is joined to at least a portion of the fitment 702. Optionally, the fitment is fully assembled 704. The liner and fitment are placed within a container 706. The liner is pressurized 708. The fitment is joined to the container 710.

Figure 8:
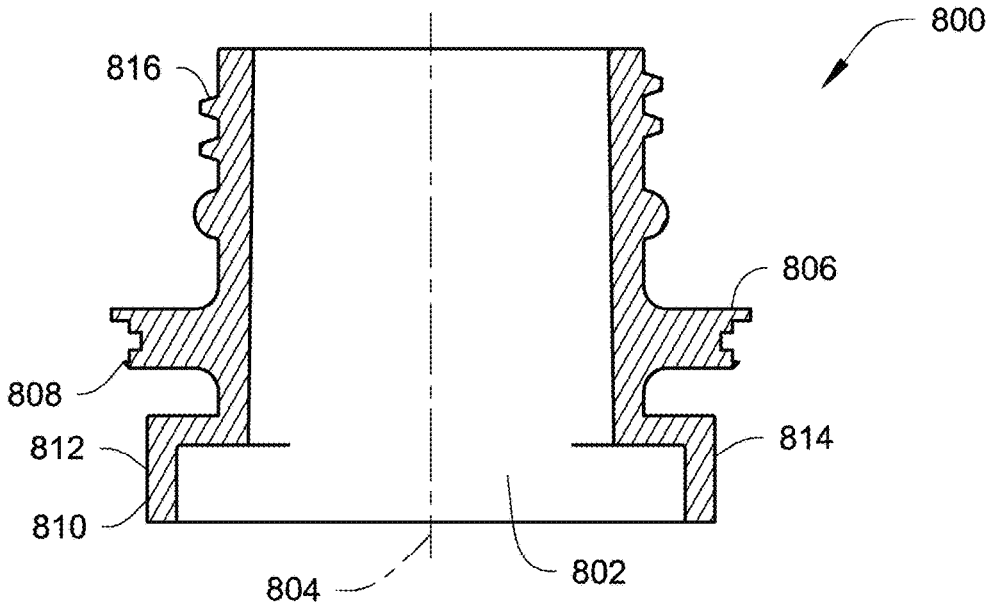
FIG. 8 shows a section view of a fitment, according to an embodiment.

The liner is joined to at least a portion of the fitment 702. In an embodiment, the liner is joined to the entire fitment, such as an assembled fitment as shown in FIGS. 1A and 2 or a fitment 800 as shown in FIG. 8. In an embodiment, the liner is joined to only a portion of a fitment, such as liner fitment 300 or liner fitment 400 shown in FIGS. 3A-3B and 4A-4C, respectively, prior to their assembly with a retainer such as retainer 500 (FIG. 5A-5B). The liner may be liner 600 as described above. The liner may be joined to the fitment or portion of a fitment 702 by, for example, ultrasonic welding, heat sealing, adhesives, or the like. In an embodiment, the liner is assembled as it is joined to the portion of the fitment.

Optionally, where the liner is joined to only a portion of a fitment in 702, the fitment may be assembled 704. The fitment is assembled by joining the components, such as a retainer (e.g., retainer 500) and a liner fitment such as liner fitment 300 or liner fitment 400. The components may include the liner fitment such as liner fitment 300 or liner fitment 400 and a retainer such as retainer 500. The liner fitment and the retainer may be joined by, for example, mechanical interference such as snaps or threads, friction such as press-fitting or an O-ring disposed between the liner fitment and retainer, or by adhesives.

The liner and fitment are placed within a container 706. The liner is placed entirely within a container such as container 102 used in containment system 100 described above and shown in FIGS. 1-3. The fitment is surrounded by a perimeter of an aperture of the container. In an embodiment, the container joining surface, such as container joining surface 120 is placed in contact with a corresponding joining surface 120*a*.

The liner is pressurized 708. Pressurizing the liner may be accomplished via, for example, a gas tube providing gas to a liner fitment aperture such as liner fitment aperture 302. Pressurizing the liner may be performed while the container, liner, and fitment are inside an ultrasonic welding device, for example by providing a gas source such as a gas tube, apertures in a bell of the ultrasonic welding device, or the like. Pressurizing the liner 708 expands the liner inside the container. In an embodiment where the fitment is joined to the container by an airtight seal, pressurizing the liner may be performed prior to joining the fitment to the container 710.

The fitment is joined to the container 710. The fitment and the container may be joined by ultrasonic welding, heat sealing, adhesives, or the like. In embodiments, the fitment and container may be joined by mechanical interference such as snaps or threads, friction such as press-fitting or an O-ring disposed between the liner fitment and retainer, or by adhesives. Joining the fitment to the container 710 may be performed while the liner is pressurized. In an embodiment, the liner is pressurized 708, and then pressure is maintained while joining the fitment to the container 710. In an embodiment, the liner is pressurized 708 while the container and fitment are in an ultrasonic welding device used to join the fitment to the container 710. In an embodiment, the gas source used to pressurize the liner 708 continues to be in use to maintain pressure in the liner as the ultrasonic welding device is used to form an ultrasonic weld joining the fitment to the container.

FIG. 8 shows a fitment 800, according to an embodiment. Fitment 800 defines an aperture 802 extending in a length direction 804 of the fitment 800. Fitment 800 may include a container joining surface 808, and a liner joining surface 810. In an embodiment, container joining surface 808 is located on a flange 806 extending outwards from the fitment 800. In the embodiment shown in FIG. 8, liner joining surface 810 is located on first end point 812 and second end point 814, and on surfaces (not visible in the section view of FIG. 8) extending from the first end point 812 to the second end point 814, as in the liner joining surface 410 described above and shown in FIG. 4. In an embodiment, liner joining surface 810 may be located on a flange, similar to liner joining surface 308 and flange 306 described above and shown in FIG. 3. In the embodiment shown in FIG. 8, fitment 800 is a unitary fitment, formed of a one-piece construction including both liner joining surface 810 and container joining surface 808, instead of a separate retainer and liner fitment. A unitary fitment may be made of a material weldable to both a container and a liner. A unitary fitment may be used for containment systems used to contain chemicals that are not particularly sensitive to the cleanliness or reactivity of the liner and fitment materials.

In an embodiment, one or more vent holes may be formed in fitment 800, for example in the flange 806. The vent holes may allow fluid communication between an outside of a fluid containment system including the fitment 800 and a space between a liner joined to the liner joining surface 810 and a container joined to the container joining surface 808 of the fitment 800, for example to pressurize that space when dispensing a chemical stored in the liner of the fluid containment system. The vent holes may allow air to enter or leave a space between a liner and a container joined by the fitment 800, for example in response to changes in the volume of the liner.

Fitment 800 may be made of one or more polymers having suitable joining characteristics relative to a container and a liner, chemical resistance or compatibility, and/or other properties required by an application for a fluid containment system, such as UV blocking and the like. In an embodiment, a coating such as a fluoropolymer which may be a homopolymer or a copolymer of a fluoropolymer, such as PFA or the like, may be applied to the wetted surfaces of the fitment 800 such as an inner surface of the fitment 800 defining aperture 802 of the fitment 800. In an embodiment, the entire fitment 800 is made of a fluoropolymer which may be a homopolymer or a copolymer of a fluoropolymer, for example PFA. In an embodiment, the fitment 800 is coated with a surface treatment, such as a UV-absorbing coating, or other coatings to improve cleanliness and/or chemical compatibility.

The fitment 800 may be used in a fluid containment system, for example, where a fitment material provides all of the needed properties for an application the fluid containment system is to be used for. For example, if a fluid containment system is to be used for storage of a chemical for which UV protection is not important, and a fluoropolymer, which may be a homopolymer or a copolymer of a fluoropolymer, can be successfully joined to the container 102, the unitary fitment 800 may be used in place of systems having separate retainers such as retainer 500 and separate liner fitments such as liner fitment 300 or liner fitment 400. The fitment 800 can include threads 816 for receiving a cap or the like.

Figure 9A:
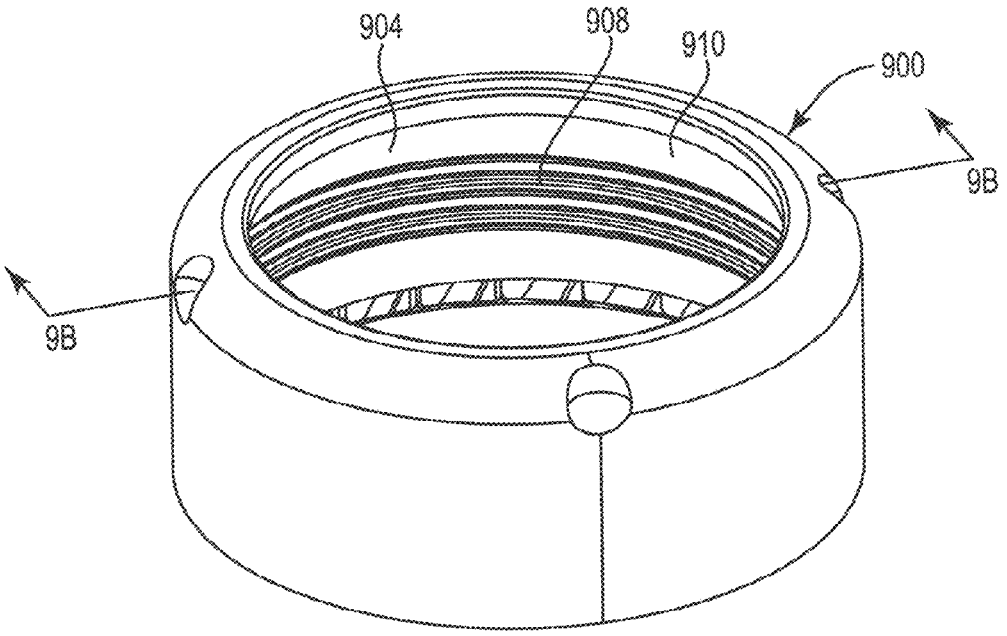
FIG. 9A is an isometric view of a closure ring according to an embodiment.
Figure 9B:
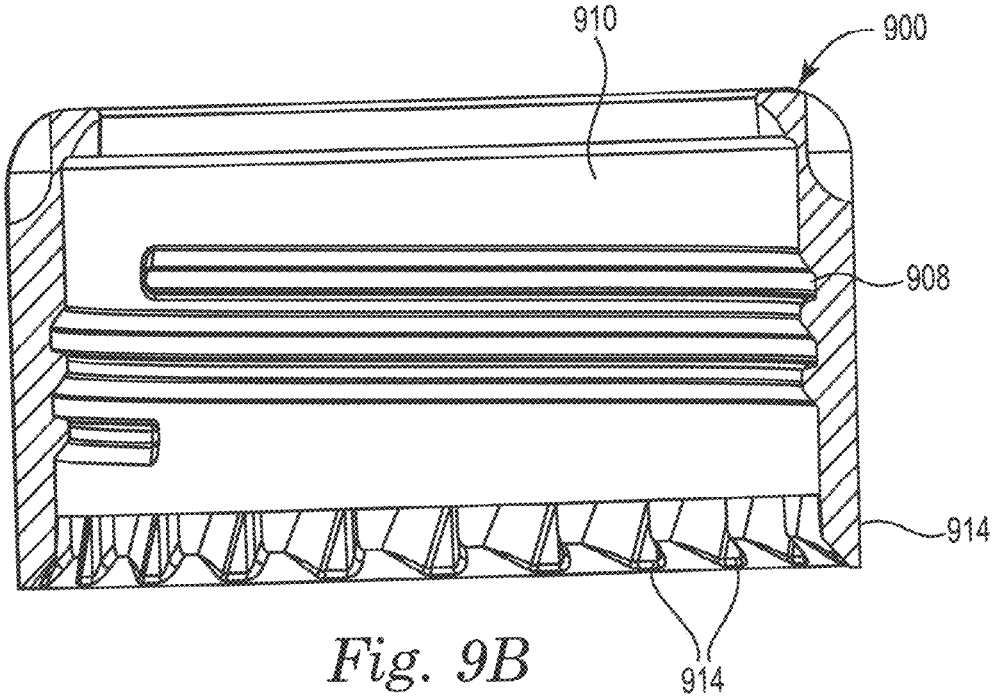
FIG. 9B is a cross-sectional view of the closure ring of FIG. 9A taken along line 9B-9B.
Figure 10A:
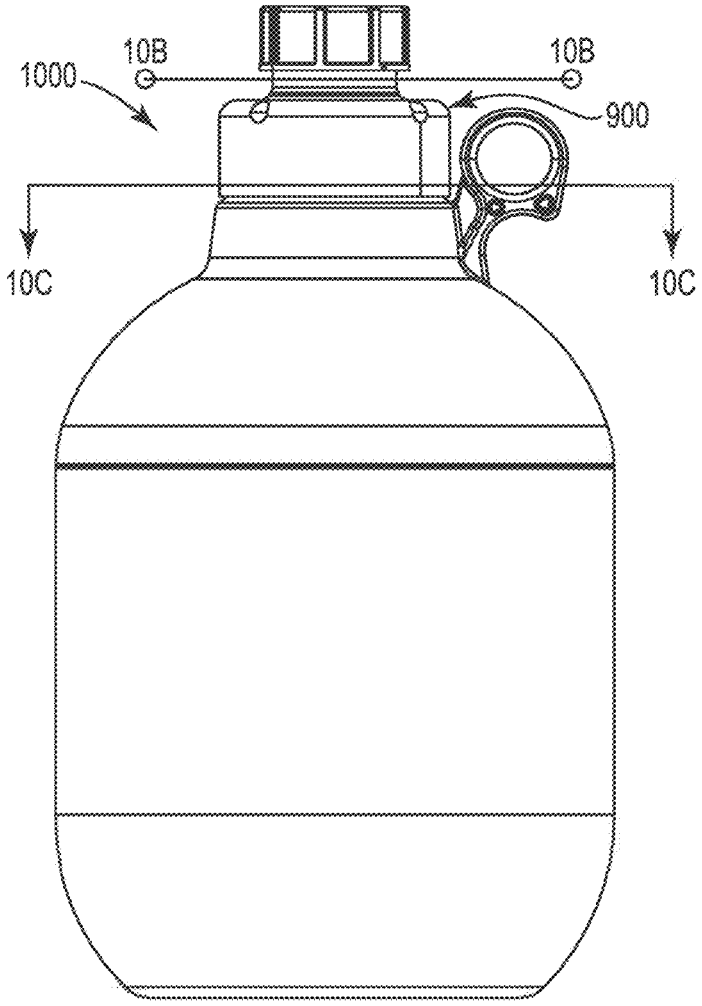
FIG. 10A is a side view of a fluid containment system including a closure ring, according to an embodiment.
Figure 10B:
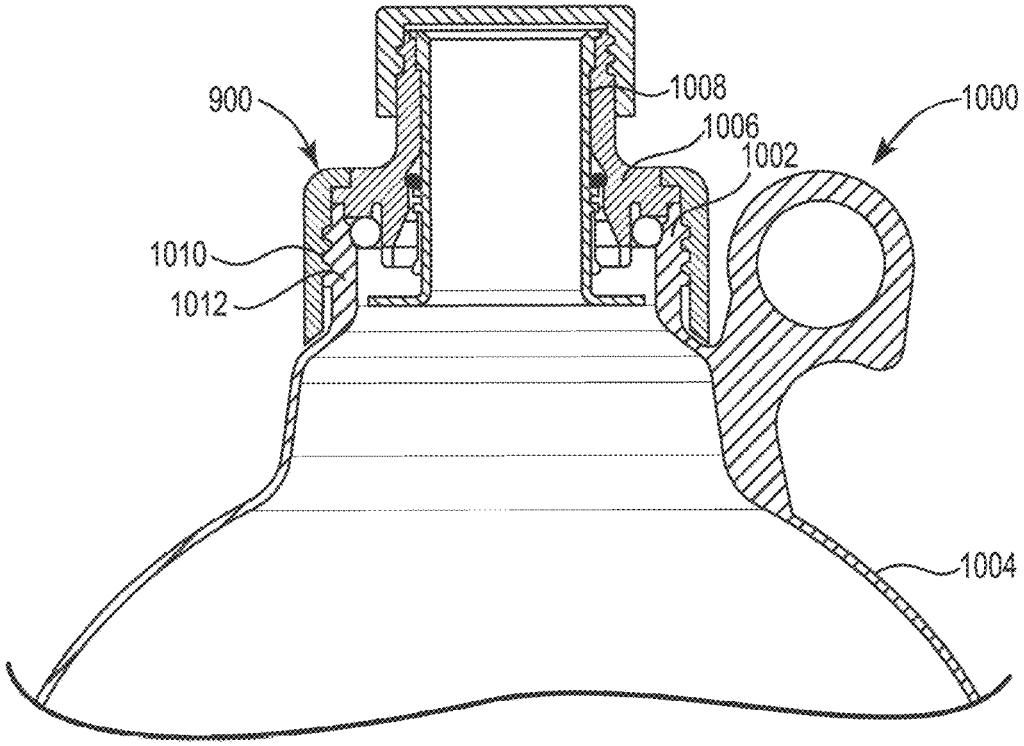
FIG. 10B is a close-up, cross-sectional view taken along line 10B-10B of a top portion of the fluid containment system shown in FIG. 10A.
Figure 10C:
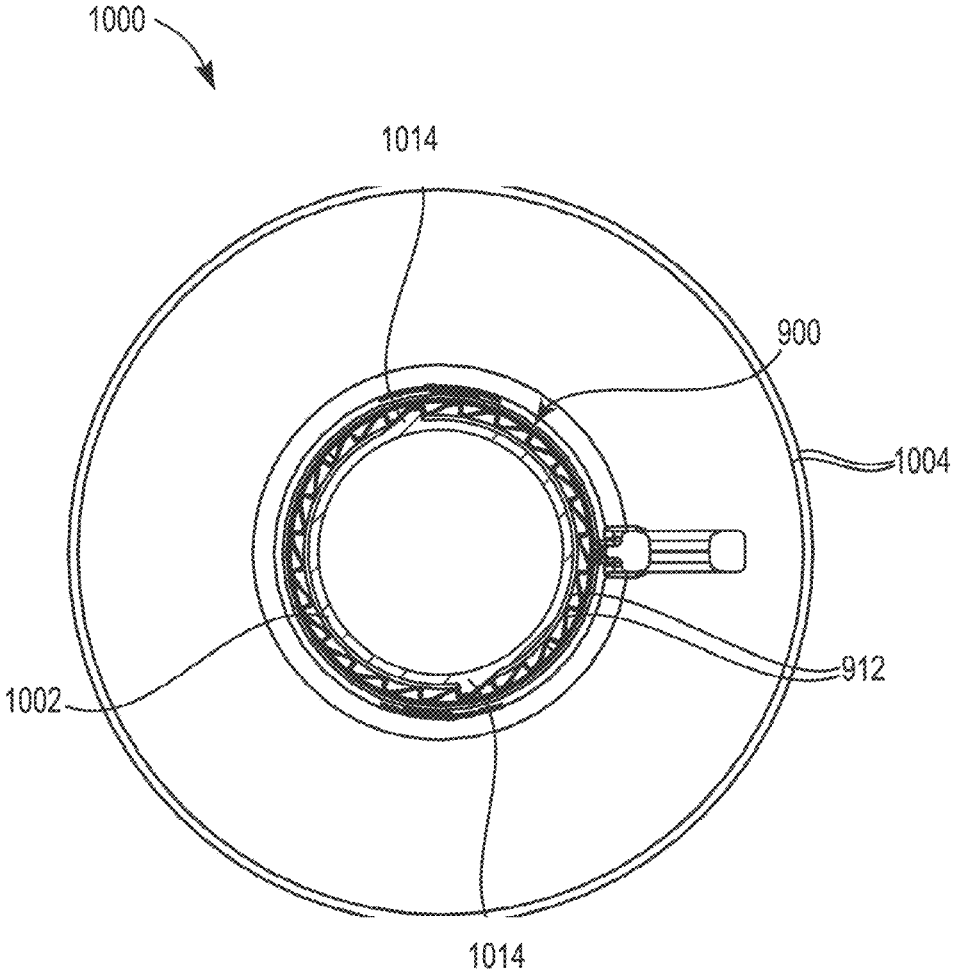
FIG. 10C is a cross-sectional view of the fluid containment system taken along line 10C-10C shown in FIG. 10A.

In some embodiments, a fluid containment system, as described herein can include a closure ring. FIGS. 9A-9B show various views of a closure ring 900, and FIGS. 10A-10C show various views of a fluid containment system 1000 including the closure ring 900 coupled with a fluid container 1004. Fluid container 1004 includes a neck 1002 to which a retainer 1006 and a fitment 1008, as described herein according to the various embodiments, are connected.

The closure ring 900 is cylindrical and includes an aperture 904 that is sized such that the closure ring 900 can be received over the neck 1002 of the fluid container 1004 including retainer 1006 and liner fitment 1008. Closure ring 900 includes a plurality of internal threads 908 provided on an inner surface 910. Internal threads 908 are configured to threadably engage external threads 1010 provided on an external surface 1012 of the neck 1002 of the fluid container 1004. For example, as shown in FIGS. 10A-10C, closure ring 900 is received over the retainer 1006 and fitment 1008 and is threadably engaged with threads 1010 provided on the outer surface 1012 of the neck 1002 of the container 1004. When the closure ring 900 is threaded onto the neck 1002 of the container 1004, closure ring 900 applies a downward pressure to the retainer 1006 which aids in retention of the liner fitment 1008 and retainer 1006 in the neck 1002 of the fluid container 1004.

Closure ring 900 also include a plurality of tines 912 extending away from the inner surface 910 in a direction towards a center of the closure ring 900. In some embodiments, as best viewed in FIG. 9B, the tines 912 are located at a bottom end 914 of the closure ring 900. As shown in FIG. 10C, tines 912 interact with protrusions 1014 provided on an external surface 1020 of the neck 1002 of the fluid container 1004 to which the closure ring 900 is coupled. According to various embodiments, the neck 1002 includes at least two protrusions spaced an equal distance apart about an outer circumference of the neck 1002 of the fluid container 1004. The interaction between tines 912 and protrusions 914 define a ratcheting system, which helps secure closure ring 900 to the fluid container 1004. In addition, once secure, protrusions 914 provide an anti-rotational function which prevents closure ring 900 from being removed from the fluid container 1004. If removed, protrusions 914 will deform indicating that the fluid containment system 1000 has been tampered with or improperly opened.

The terminology used in this specification is intended to describe particular embodiments and is not intended to be limiting. The terms "a," "an," and "the" include the plural forms as well, unless clearly indicated otherwise. The terms "comprises" and "comprising," when used in this specification, specify the presence of the stated features, integers, steps, operations, elements, or components, but do not preclude the presence or addition of one or more other features, integers, steps, operations, elements, or components.

Having thus described several illustrative embodiments of the present disclosure, those of skill in the art will readily appreciate that yet other embodiments may be made and used within the scope of the claims hereto attached. Numerous advantages of the disclosure covered by this document have been set forth in the foregoing description. It will be understood, however, that this disclosure is, in many respect, only illustrative. Changes may be made in details, particularly in matters of shape, size, and arrangement of parts without exceeding the scope of the disclosure. The disclosure's scope is, of course, defined in the language in which the appended claims are expressed.

What is claimed is:

1. A fitment for a fluid containment system, comprising:

a liner fitment, including a liner joining surface, the liner joining surface configured to be joined to a liner, wherein the liner fitment defines a liner fitment aperture and the liner fitment comprises a fluoropolymer; and a retainer, including a container joining surface, the container joining surface configured to be joined to a container, wherein the retainer defines an aperture suitable for receiving the liner fitment and wherein the liner fitment is held in the aperture by a load-bearing feature formed by an outer surface of the liner fitment and surface of the retainer and wherein the retainer is threaded at an end of the retainer aperture, wherein the liner fitment includes one or more first connection features located on the outer surface of the liner fitment and the retainer includes one or more second connection features, and the liner fitment and the retainer are joined via interface of the one or more first connection features and the one or more second connection features and further comprising a closure ring received over the liner fitment and the retainer, wherein the closure ring is configured to interface with features on a container.

2. The fitment according to claim 1, wherein the load-bearing feature includes an annular surface on an end of the fitment and wherein the annular surface extends beyond the aperture of the retainer.

3. The fitment according to claim 1, wherein the load-bearing feature is positioned on a surface of the aperture of the retainer and a corresponding surface of the liner fitment.

4. The fitment according to claim 1, wherein the liner joining surface is disposed on an annular flange.

5. The fitment according to claim 1, wherein the liner joining surface is disposed on one or more curved surfaces extending from a first end point to a second end point.

6. The fitment according to claim 1, wherein the retainer includes one or more vent holes, allowing fluid communication between a first side of the retainer to a second side of the retainer, the second side of the retainer being opposite the first side of the retainer.

7. The fitment according to claim 1, wherein the retainer comprises a polymer that is ultrasonically weldable to a stretch-blow moldable polymer.

8. The fitment according to claim 1, wherein an O-ring is located between the liner fitment and the retainer.

9. The fitment according to claim 8, further comprising an annular groove in an outer surface of the liner fitment, wherein the O-ring is located within the annular groove.

10. A containment system, comprising:

a liner;

a fitment; and a container, wherein the fitment includes:

a liner fitment having a liner joining surface joined to the liner and defining a liner fitment aperture and the liner fitment comprises fluoropolymer, a retainer, including a container joining surface, the container joining surface configured to be joined to a container, wherein the retainer defines an aperture suitable for receiving the liner fitment and wherein the liner fitment is held in the aperture by a load-bearing feature formed by an outer surface of the liner fitment and surface of the retainer, and the container surrounds the liner and wherein the retainer is threaded at an end of the retainer aperture, and a closure ring received over the liner fitment and the retainer, wherein the closure ring is threadably engaged with threads provided on the container.

11. A fitment for a fluid containment system, comprising:

a liner fitment, including a liner joining surface, the liner joining surface configured to be joined to a liner, wherein the liner fitment defines a liner fitment aperture and the liner fitment comprises a fluoropolymer;

a retainer, including a container joining surface, the container joining surface configured to be joined to a container, wherein the retainer defines an aperture suitable for receiving the liner fitment and wherein the liner fitment is held in the aperture by a load-bearing feature formed by an outer surface of the liner fitment and surface of the retainer and wherein an O-ring is located between the liner fitment and the retainer, and a closure ring received over the liner fitment and the retainer, wherein the closure ring is threadably engaged with threads provided on the container.

12. The fitment according to claim 11, further comprising an annular groove in an outer surface of the liner fitment, wherein the O-ring is located within the annular groove.

* * * * *